US005080273A

United States Patent [19]

Meyer

[11] Patent Number: 5,080,273

[45] Date of Patent: Jan. 14, 1992

[54] TRIGGER VALVE AND SAFETY MECHANISM FOR FASTENER DRIVING TOOL

[75] Inventor: Robert J. Meyer, Elmwood Park, Ill.

[73] Assignee: Duo-Fast Corporation, Franklin Park, Ill.

[21] Appl. No.: 454,042

[22] Filed: Dec. 19, 1989

[51] Int. Cl.[5] ..... B25C 1/04

[52] U.S. Cl. ..... 227/8; 227/130

[58] Field of Search ..... 227/8, 123, 130

[56] References Cited

U.S. PATENT DOCUMENTS

| | | | |
|---|---|---|---|
| 3,638,532 | 2/1972 | Novak | 91/220 |
| 3,784,077 | 1/1974 | Burke, Jr. et al. | 227/8 |
| 4,509,668 | 4/1985 | Klaus et al. | 227/8 |
| 4,573,624 | 3/1986 | Müller et al. | 227/121 |
| 4,597,517 | 7/1986 | Wagdy | 227/8 |
| 4,629,106 | 12/1986 | Howard et al. | 227/8 |

*Primary Examiner*—Frank T. Yost
*Assistant Examiner*—John M. Husar
*Attorney, Agent, or Firm*—Mason, Kolehmainen, Rathburn & Wyss

[57] ABSTRACT

A pneumatically operated fastener driving tool having a pivotally mounted magazine. The displacement of the magazine is used to actuate the tool when the nosepiece is in engagement with a workpiece. With the magazine travel kept to a minimum, the magazine is coupled to a cam lever which amplifies the displacement of the magazine. One portion of the cam lever is in engagement with a trip lever which forms a bearing surface for the trigger valve cartridge, which enables the tool when the magazine is in a drive position. The geometry of the cam lever causes a relatively greater displacement of the trip lever than the displacement of the magazine. The fastener driving tool also includes a poppet valve for controlling the compressed air flow into the drive cylinder. The top portion of the poppet is subject to the compressed air reservoir within the tool. A poppet chamber disposed at the bottom of the poppet controls the opening and closing of the poppet valve. An important aspect of the invention are the throttling inlet and exhaust passageways to the poppet chamber which allow the pressure in the poppet chamber to be controlled, thus reducing poppet flutter.

22 Claims, 5 Drawing Sheets

TRIGGER VALVE AND SAFETY MECHANISM FOR FASTENER DRIVING TOOL

BACKGROUND OF THE INVENTION

1. Field of the Invention

This invention generally relates to a fastener driving tool and more particularly to a pneumatically operated fastener driving tool having a pivotally mounted magazine interlocked with a trigger assembly which includes a cam lever for amplifying the displacement of the magazine assembly and a snap action poppet valve assembly for controlling the compressed air supply to the drive piston.

2. Description of the Prior Art

Fastener driving tools are generally known in the art. Some such tools include a trigger interlock which prevents operation of the tool unless it is in engagement with a workpiece. More specifically, in some known tools a safety yoke is provided which extends downwardly from the nosepiece. Such safety yokes generally include an integrally formed lever which actuates a trigger pin when the nosepiece is in engagement with the workpiece. Such tools cannot be operated unless the trigger pin is actuated.

In other known tools a pivotally mounted magazine is provided instead of a safety yoke. Such tools are generally used in applications where a safety yoke would be awkward and cumbersome. An example of such a tool with a pivotally mounted magazine is disclosed in U.S. Pat. No. 3,638,532, assigned to the same assignee as the present invention and hereby incorporated by reference. In such tools, the displacement of the magazine is relatively small. Since this displacement is necessary to actuate the trigger valve, it is necessary to maintain a relatively close tolerance of the components which comprise the interlock to prevent improper trigger valve timing. More specifically, the trigger valve controls the driving of a fastener into a workpiece. If the operation is premature (i.e., the tool is operated before the magazine is in the operate position), this can result in inadequate follow-through of the driver blade causing the fastener to be improperly driven into a workpiece. On the other hand, if the valve timing is delayed, the driver blade follow-through could result in an undesirable multiple operation condition. Accordingly, in order to solve such problems, known fastener driving tools utilize relatively close tolerance components used for the trigger interlocks. However, such components can be relatively expensive resulting in a relatively higher cost tool.

Another problem with pneumatically operated fastener driving tools is known as poppet flutter. Poppet valves are used to control the compressed air flow into a drive cylinder which houses the drive piston which has a driver blade rigidly attached thereto. The type of poppet valve in question has what is known as a fixed differential. More specifically, the area on which pressure acts remains constant regardless if the poppet is open or closed. In the static position, the poppet valve is closed and consequently the air passageway to the drive cylinder is sealed off. In this position, a spring and compressed air bias the poppet valve closed. In a drive position an exhaust passageway is opened to release the air bias on the poppet. This uncontrolled release of the air bias can result in fluttering of the poppet valve possibly causing a misoperation of the tool. More specifically, when the air bias is not controlled when released, a constant differential pressure is created across the poppet valve which can cause the poppet valve to flutter if the pressure release is not controlled. Additionally, the constant differential poppet eliminates the use of a relatively larger varying differential poppet which would be needed for the required air flow. The use of a relatively larger poppet results in a dimensionally larger and more expensive tool.

SUMMARY OF THE INVENTION

It is an object of the present invention to provide a fastener driving tool which solves the problems associated with the prior art.

It is another object of the present invention to provide a trigger valve interlock for a fastener driving tool having a pivotally mounted magazine which does not require relatively close tolerance of its components.

It is yet a further object of the present invention to provide a pneumatically operated fastener driving tool having a poppet valve which operates with a fixed differential with a controlled release of pressure to eliminate fluttering.

It is yet a further object of the present invention to provide a fastener driving tool with means for gradually reducing the air bias as the poppet valve is being opened.

Briefly, the present invention relates to a pneumatically operated fastener driving tool having a pivotally mounted magazine. The displacement of the magazine is used to actuate the tool when the nosepiece is in engagement with a workpiece. With the magazine travel kept to a minimum, the magazine is coupled to a cam lever which amplifies the displacement of the magazine. The geometry of the cam causes a relatively greater displacement of the trip lever than the displacement of the magazine. One portion of the cam lever is in engagement with a trip lever which forms a bearing surface for a trigger valve cartridge which enables the tool when the magazine is in a drive position. The fastener driving tool also includes a poppet valve for controlling the compressed air flow into the drive cylinder. The top portion of the poppet is subject to the compressed air reservoir within the tool. A poppet chamber disposed at the bottom of the poppet controls the opening and closing of the poppet valve. An important aspect of the invention relates to the throttling inlet and exhaust passageways to the poppet chamber which control the exhaust of the poppet chamber, thus reducing poppet flutter.

DESCRIPTION OF THE DRAWING

These and other objects and advantages of the present invention will become readily apparent upon consideration of the following detailed description of the attached drawing, wherein.

DETAILED DESCRIPTION

Figure 1:
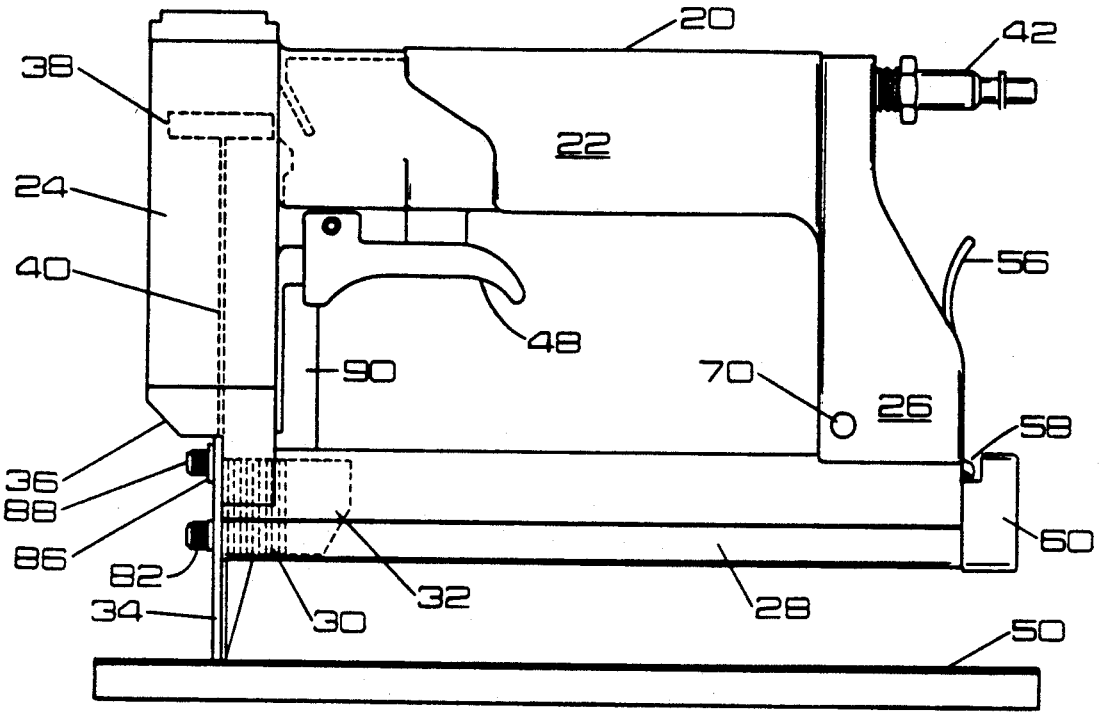
FIG. 1 is an elevational view of the fastener driving tool in accordance with the present invention.

The tool in accordance with the present invention is generally identified with the reference numeral 20. The tool includes a handle portion 22, a drive cylinder 24 and a rear handle yoke 26. A magazine assembly 28 is pivotally connected to the rear handle yoke 26 as will be discussed in more detail below. The magazine assembly 28 acts as a carrier for carrying a supply of fasteners 30, such as staples. A pusher 32 advances the fasteners 30 toward a drive track formed in a nosepiece assembly 34. A nosepiece assembly 34 is connected to the front portion of the magazine assembly 28. The nosepiece assembly 34 is reciprocally mounted with respect to a front flange portion 36, disposed on the bottom portion of the drive cylinder 24.

The drive cylinder 24 includes a piston 38. A driver blade 40 is rigidly attached to the bottom surface of the piston 38 for reciprocal movement within a drive track. As will be discussed in detail below, compressed air from an external source is applied to a pneumatic fitting 42, disposed adjacent the rear portion of the handle 22. The handle 22 is formed as a hollow member which serves as a reservoir of compressed air for the drive cylinder 24. A poppet valve 44 controls the flow of compressed air into and out of the drive cylinder 24. The poppet valve 44, in turn, is controlled by a trigger valve assembly 116. The trigger valve assembly 116 is coaxially mounted and interlocked with a trigger assembly 48 to preclude operation of the tool 20 unless the nosepiece assembly 34 is in engagement with a workpiece 50.

The magazine assembly 28 includes an enlongated carrier 52 slidably mounted to a guide rail 54. The guide rail 54 includes a latch assembly shown in part which includes a latch handle 56 and an integrally formed latch lever 58. The latch lever 58 is pivotally mounted with respect to the guide rail 54 and latches the elongated carrier 52 in an operate position. More specifically, the latch lever 58 engages a tab (not shown) formed in the rear portion of the elongated carrier 52. When the latch lever 58 is released by rotating the latch handle 56, the elongated carrier 52 is free to slide rearwardly to allow fasteners 30 to be replaced. A handle 60, rigidly attached to the rear of the elongated carrier 52, facilitates movement of the elongated carrier 52. Latch assemblies are well known in the art and does not form a part of the present invention.

The magazine assembly 28 is pivotally connected to the tool 20. More specifically, the rear portion of the guide rail 54 is pivotally connected to the rear handle yoke 26. An upwardly projecting boss 62 connects to the rear of the handle yoke 26 at an aperture 64. The rear handle yoke 26 is provided with a pair of aligned apertures 66 provided in oppositely disposed leg portions 68. The aligned apertures 66 in the leg portions 68 of the rear handle yoke 26 are aligned with the aperture 64 in the boss 62. A pin 70 is inserted into the apertures 64 and 66 forming a clevis joint to allow the magazine assembly 28 to pivot with respect to the rear handle yoke 26. The pin 70 may be retained by various means including "E" clips or by peening.

The nosepiece assembly 34 is attached to the front of the magazine assembly 28. More specifically, the nosepiece assembly 34 includes a rear nosepiece 72 and a front nosepiece 74. The front and rear nosepiece 74, 72 form a drive track for the fasteners 30. The rear nosepiece 72 is rigidly attached to the elongated carrier 52, for example, by welding. The front nosepiece 74 is slidingly attached to the front flange 36 and rigidly to the guide rail 54. More specifically, the front nosepiece 74 is provided with a pair of apertures 78, adapted to be aligned with threaded holes 80 in the front portion of the guide rail 54. Threaded fasteners 82 are used to secure the front nosepiece 74 to the guide rail 54. The front nosepiece 74 is provided with a pair of slots 76. The length of the slots 76 control the amount of pivotal movement of the magazine assembly 28. The front flange 36 is provided with a pair of threaded holes 84. These holes 84 are adapted to be aligned with the slots 76. In order to allow for pivotal movement of the magazine assembly 28, a pair of shoulder washers 86 are disposed in the slots 76. Threaded fasteners 88 are inserted through the shoulder washers 86 and into the threaded holes 84 in the flange 36.

Figure 2:
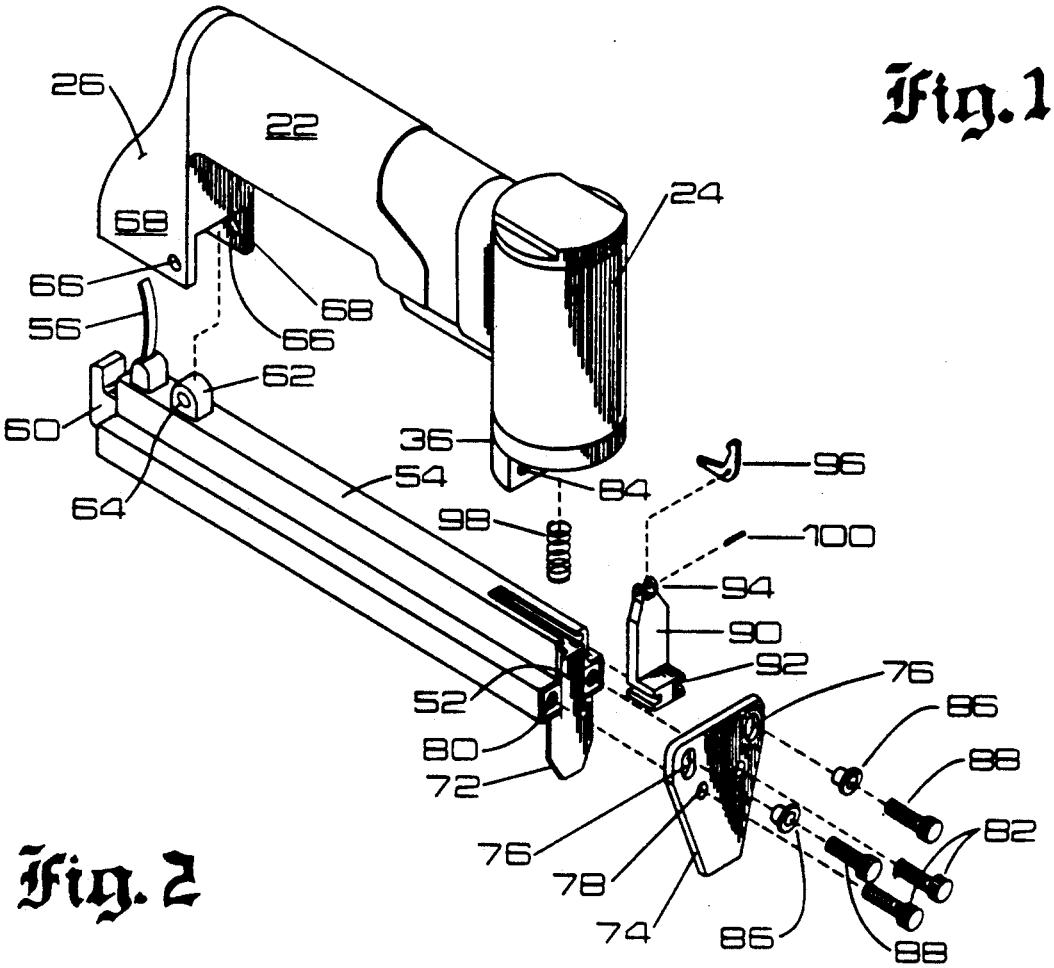
FIG. 2 is an exploded perspective view of some of the components of the fastener driving tool of FIG. 1, illustrating the assembly of a pivotally mounted magazine and the cam lever.

A control lever 90 is rigidly attached to the top of the guide rail 54. The control lever 90 is formed as an L-shaped member having a base portion 92 and a yoke portion 94. The control lever 90 is disposed adjacent the front of the guide rail 54 to allow the yoke portion 94 to communicate with the trigger assembly 48. The control lever 90 may be rigidly attached to the guide rail 54, for example, by a tongue and groove arrangement as shown in FIG. 2. A compression spring 98 is disposed between the base portion 92 of the control lever 90 and the flange 36. The compression spring 98 biases the magazine assembly 28 downwardly.

Figure 3:
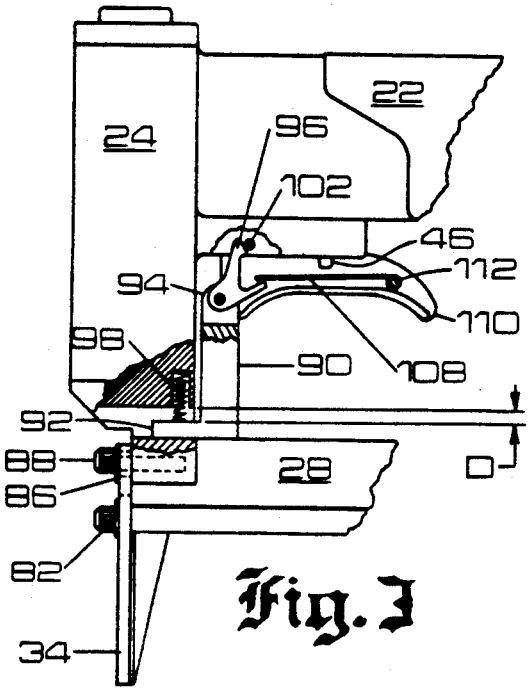
FIG. 3 is a partial elevational view of the tool in FIG. 1 partially broken away to illustrate the position of the cam in accordance with the present invention in a static position.
Figure 4:
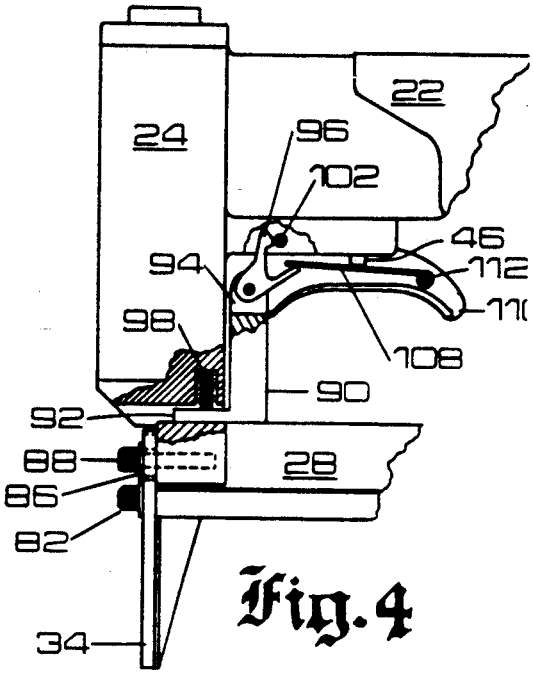
FIG. 4 is similar to FIG. 3 and illustrates the position of the components in a drive position.
Figure 5:
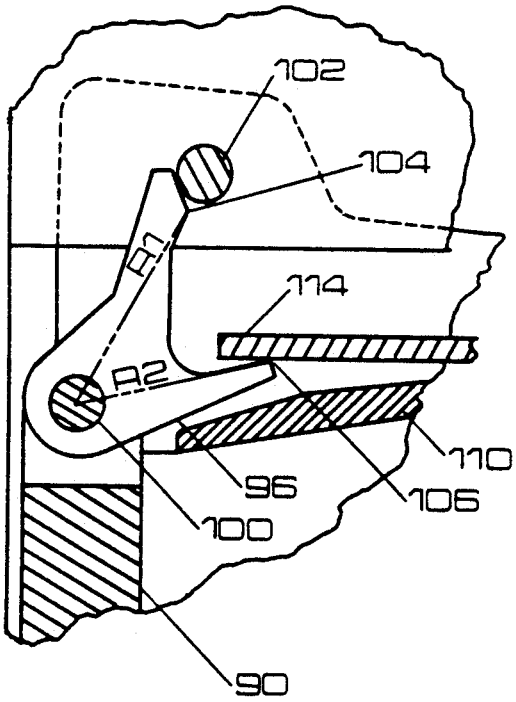
FIG. 5 is similar to FIG. 3 and is an enlarged sectional view of the position of the cam lever in a static position.
Figure 6:
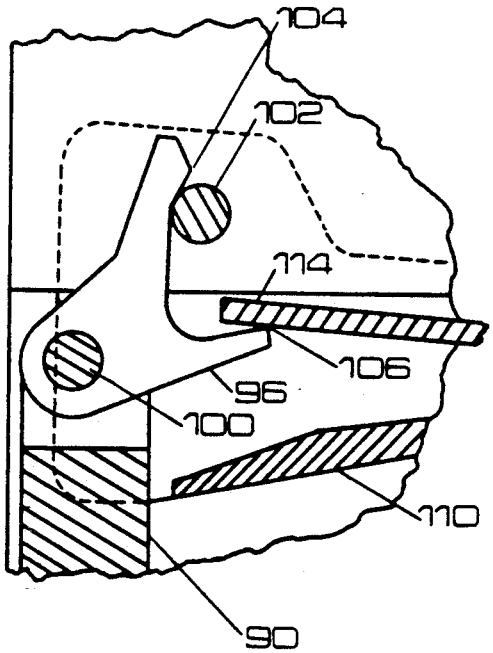
FIG. 6, similar to FIG. 5, illustrates the position of the cam lever in the drive position.

A trip lever 108 forms a bearing surface for the trigger pin 46. The trip lever 108 is pivotally mounted at the rear of the trigger 110 by a pin 112. The free end 114 of the trip lever 108 engages a control surface 106 in an overlapping fashion as shown in FIGS. 3–6. In the static position, as shown in FIGS. 3 and 5, the trip lever 108 is spaced away from the trigger pin 46. In this position, actuation of the trigger 110 will not operate the tool 20. However, in the drive position as shown in FIGS. 4 and 6, the trip lever 108 forms a bearing surface for the trigger pin 46 to allow the tool to be actuated.

An important aspect of the invention relates to a cam lever 96, pivotally attached to the yoke portion 94 of the control lever 90 by way of a pin 100. The cam lever 96 amplifies the displacement of the magazine assembly 28.

Referring to FIGS. 3–6, the cam lever 96 cooperates with a cam follower 102 which rides along the surface of the cam lever 96 to cause it to rotate when the magazine assembly 28 is moved upwardly or downwardly. More specifically, the cam lever 96 is shown in its static position in FIGS. 3 and 5. In this position, the magazine assembly 28 is disposed downwardly. When the nosepiece assembly 34 is placed into engagement with a workpiece 50, this causes the magazine assembly 28 to pivot upwardly. Since the control lever 90 is rigidly attached to the magazine assembly 28, such movement of the magazine assembly 28 causes corresponding movement of the control lever 90. Because the cam follower 102 is a fixed pin, movement of the control lever 90 causes the cam lever 96 to rotate. More specifically, when the control lever 90 is moved upwardly, the cam lever 96 rotates in a counterclockwise direction (FIGS. 4 and 6). Similarly, when the control lever moves downwardly to the static position as shown in FIGS. 3 and 5, the cam lever 96 rotates in a clockwise direction.

An important aspect of the invention relates to the fact that the cam lever 96 is able to amplify the displacement of the magazine assembly 28. This is accomplished by the control surfaces 104 and 106 formed on the cam lever 96. The control surface 104 is the surface upon which the cam follower 102 rides. The control surface 106 is the surface which engages a trip lever 108.

The upward movement D (FIGS. 3 and 4) of the magazine assembly 28 causes movement of the control surface 104 on the cam lever 96 by an amount S1. The arcuate movement of the control surface 104 is governed by the following equation 1:

$$[1] S = R\theta$$

where S = the arcuate displacement of a point R1 (FIG. 5) on the control surface 104 from the pivot pin 100
R = the radius of a point on a central surface, and $\theta$ = the angular displacement of the cam lever 96.

For simplicity in explaining the principle, assume that one point along the control surface 104 has a radius R1 with respect to the pivot pin 100 as shown in FIG. 5. Further assume that the control surface 106 is at a radius R2 (FIG. 5) from the pivot pin 100. The displacements S1 and S2 of a point at radius R1 along the control surface 104 and a point at radius R2 along the control surface 106 will be as provided in equation [2] for a given angular displacement $\theta$ of the cam lever 96.

$$[2] \theta = S1/R1 = S2/R2$$

Thus, the following relationship can be solved for S1 and S2 as shown in equation 3.

$$[3] S2 = S1(R2/R1)$$

Thus, the point at radius R2 along the control surface 106 will be displaced along an arcuate path S2 for a given angular displacement $\theta$ of the cam lever 96. This distance S2 is then added to the upward movement D (FIG. 3) of the control lever 90, thus amplifying the original distance D to allow the linear displacement of the magazine assembly 28 to be amplified.

The shape of the control surfaces 104 and 106 controls the relationship between the corresponding displacements For example, if the control surface 104 acts through substantially a single point as shown for the control surface 106 in FIGS. 3–6, the amplification would be constant and linearly related to the displacement of the magazine assembly 28. As shown in FIGS. 3–6, the control surface 104 is formed with a non-linear surface. Accordingly, this provides a non-linear relationship between the displacement of the magazine assembly 28 and the trip lever 108 displacement. Various geometries of the control surfaces 104 and 106 are possible which amplify the displacement of the magazine assembly 28 by various linear and non-linear relationships. All such geometries are intended to be covered by the broad scope and principles of the present invention. The non-linear geometry illustrated for the control surface 104 is merely intended to be exemplary.

Figure 7:
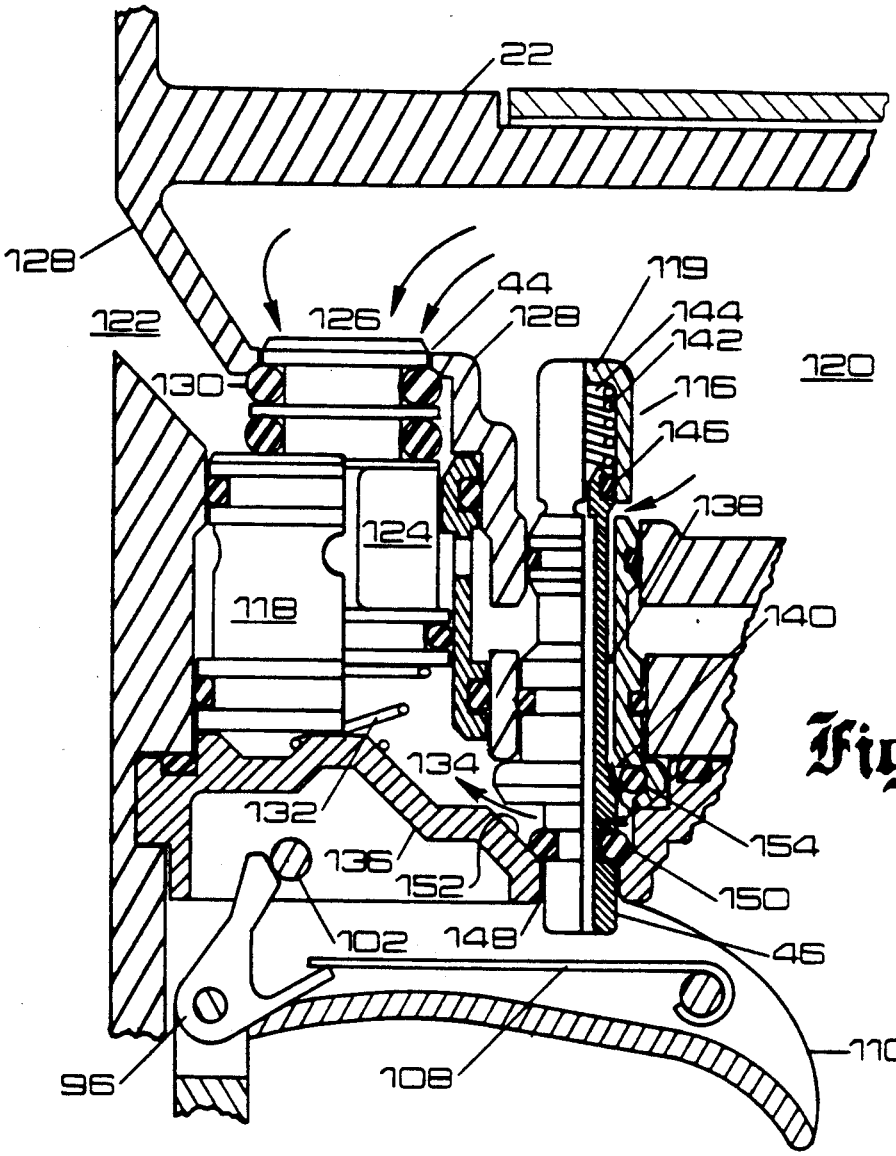
FIG. 7 is a partial sectional view of the fastener driving tool of FIG. 1 illustrating the trigger valve assembly in accordance with the present invention in a static position.

Another important aspect of the invention relates to eliminating a condition known as poppet flutter. This aspect of the present invention is best illustrated in FIGS. 7–12. More specifically, FIG. 7 shows the position of a trigger valve assembly 116 in accordance with the present invention in a static position. The trigger valve assembly 116 includes a poppet valve 44, a trigger valve cartridge 119 and a poppet valve housing 118. The poppet valve housing 118 is a cylindrical member, shown partially broken away in FIGS. 7–9.

The poppet valve 44 is disposed between the compressed air reservoir 120 and a chamber 122 in communication with the drive cylinder 24. As shown in FIG. 7, the poppet valve 44 is in a closed position. In this position, poppet valve 44, which includes a poppet 124, closes an opening 126 formed by the fixed members 128. An O-ring 130 is provided adjacent the top end of the poppet 124 to provide a seal. A biasing spring 132 is provided to bias the poppet 124 upwardly. The biasing spring 132 is located in a poppet chamber 134 and is disposed between the bottom surface of the poppet 124 and a fixed member 136.

In the static position, as shown in FIG. 7, compressed air from the reservoir 120 enters a passageway 138 formed in the trigger valve cartridge 119, shown partially broken away. The passageway 138, formed in the trigger valve cartridge 119, extends substantially the length thereof. The passageway 138, as will be discussed in detail below, includes a throttling surface 140 through which the compressed air flows on its way into the poppet chamber 134 as shown by the arrows in FIG. 7. The combination of the spring force from the biasing spring 132 and the air pressure in the poppet chamber 134 seals the poppet 124 against the opening 126 to prevent compressed air from entering the drive cylinder 24. In this position, compressed air from the reservoir 120 acts on the top surface of the poppet 124 creating a relatively high force differential thereacross.

The trigger pin 46 is biased downwardly in the static position by a spring 142 disposed in a chamber 144 in the upper portion of the trigger valve cartridge 119. An O-ring 146 is provided to seal the chamber 144 from the compressed air supply in the reservoir 120. By sealing the chamber 144 operating forces are applied to the trigger valve cartridge 46 can be reduced by reducing the air bias. The biasing spring 142 also insures a good seal at an exhaust port 148. More specifically, an O-ring 150 is disposed about the bottom portion or the trigger pin 46. This O-ring 150 engages a throttling surface 152 to seal the exhaust port 148.

Figure 8:
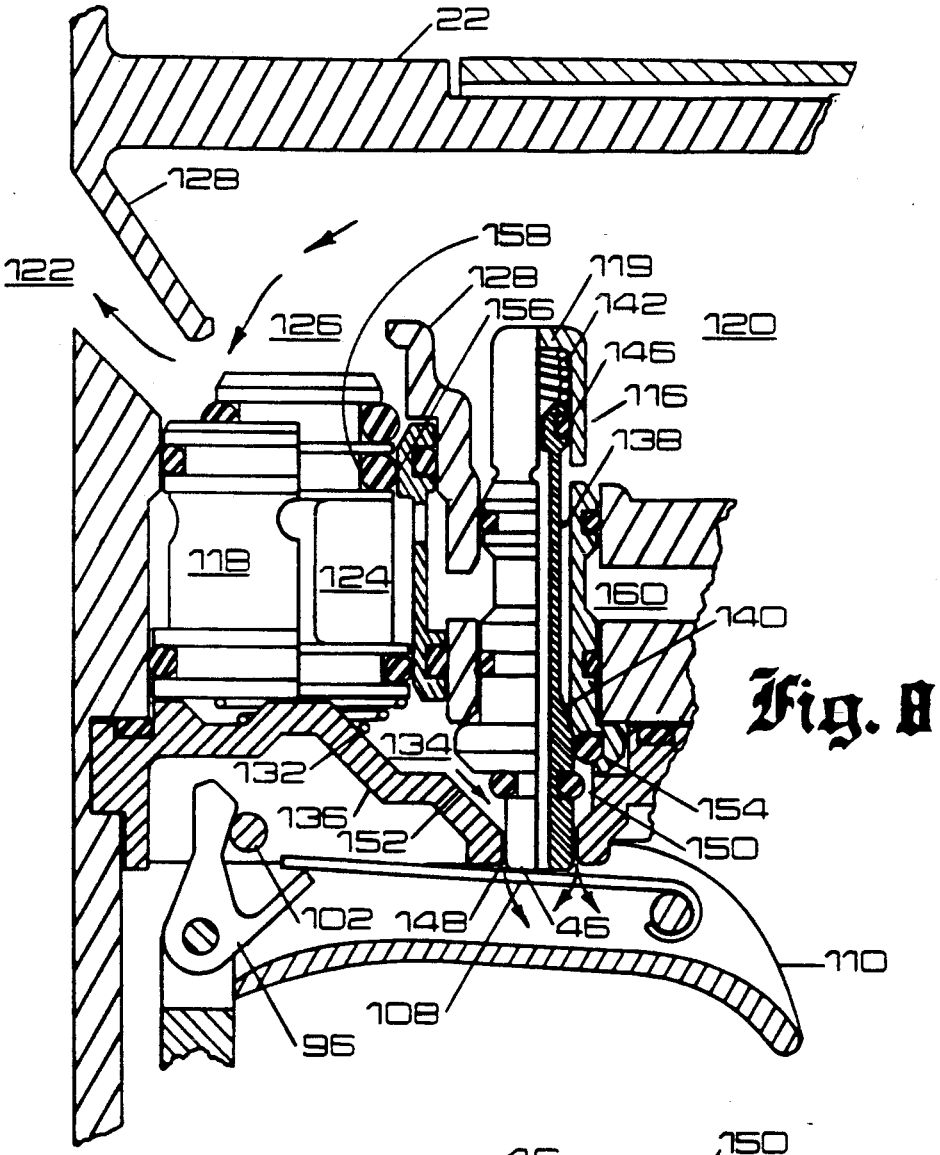
FIG. 8 is similar to FIG. 7 and illustrates the trigger valve assembly in the drive position.

The drive position is illustrated in FIG. 8. In this position, minimal movement of the magazine assembly 28 causes the cam lever 96 to rotate in a counterclockwise direction when the nosepiece assembly 34 engages a workpiece 50. This action, in turn, causes the trip lever 108 to rotate in a clockwise direction (FIG. 8) thus engaging the trigger pin 46. In this position, the trip lever 108 acts as a bearing surface for the trigger pin 46. When the trigger 110 is depressed, the trigger pin 46 is displaced upwardly against the force of the biasing spring 142. As the trigger pin 46 begins shifting upwardly, the inlet throttling surface 140 is slowly closed by an O-ring 154. More specifically, the throttling surface 140 is formed as a sloped surface; sloping toward the O-ring 154. Thus, as the trigger pin 46 is moved upwardly, the passageway 138 is gradually and slowly closed. The action of the upward movement of the trigger pin 46 also causes an exhaust port 148 to be slowly and gradually opened by the O-ring 150. A throttling surface 152 is also, shaped as a sloped surface similar to the throttling surface 40.

Figure 10:
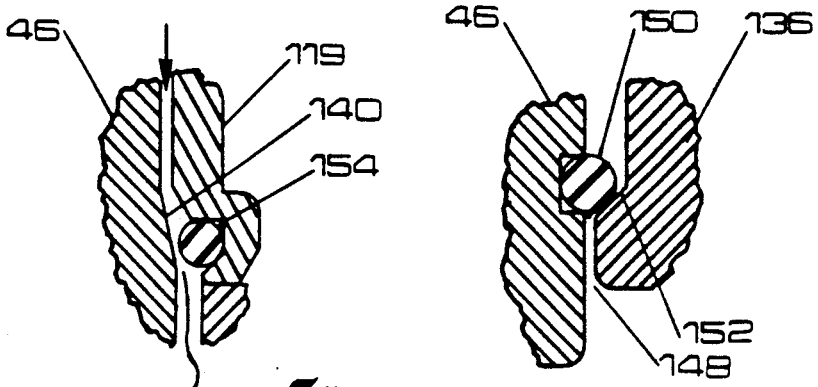
FIG. 10 is a pair of partial sectional views of the throttling inlet and exhaust passageways to the poppet chamber in accordance with the present invention in the static position.
Figure 11:
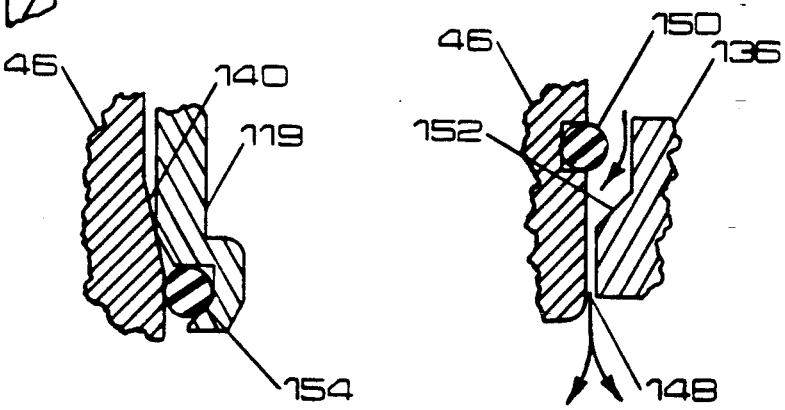
FIG. 11 is similar to FIG. 10 and illustrates the inlet and exhaust passageways to the poppet chamber in a drive position.
Figure 9:
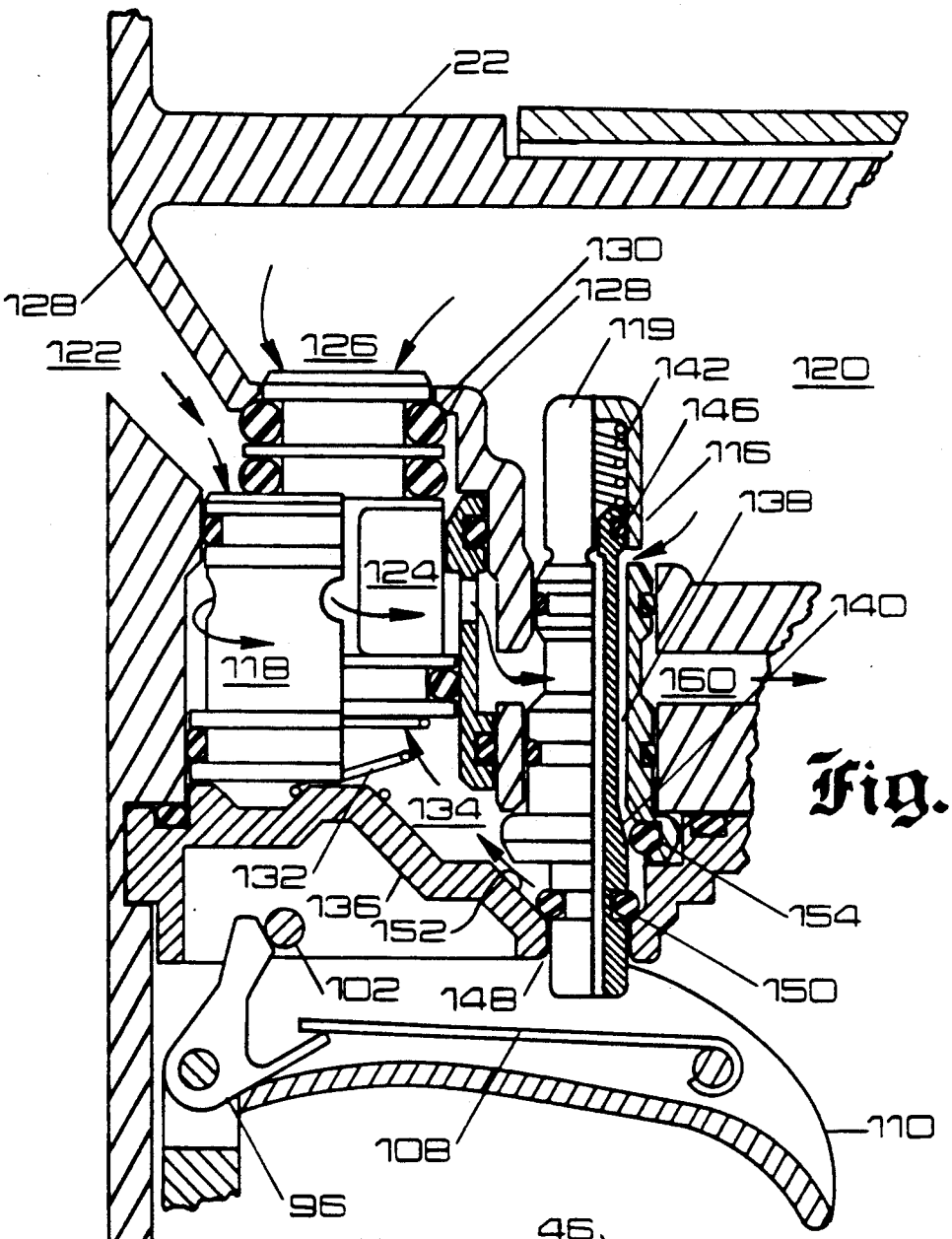
FIG. 9 is also similar to FIG. 7 and illustrates the position of the trigger valve assembly in a return position.
Figure 12:
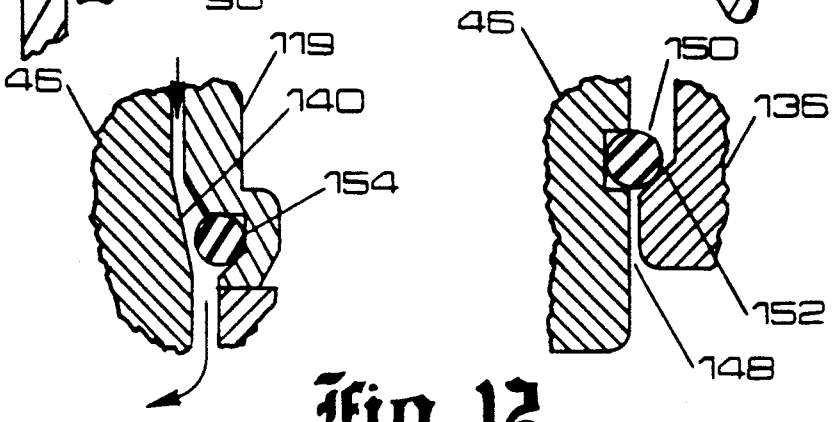
FIG. 12 is similar to FIG. 10 and illustrates the position of the throttling inlet and exhaust passageways to the poppet chamber in a return position.

As best shown in FIGS. 10–12, since the flow rate of the compressed air is a function of the orifice size, the throttling surfaces 140 and 152 allow the inlet and outlet flow rates to be slowly and gradually changed. This gradual throttling of the inlet and exhaust to the poppet chamber 144 allows the differential pressure across the poppet 124 to be gradually reduced until it reaches a very narrow band of differential pressure at which the poppet 124 will open with a snap action effect. Once the narrow band of differential pressure is reached, the poppet 124 will move downwardly as shown in FIG. 8. The poppet 124 is driven downwardly by the air pressure acting on top of the poppet from the reservoir 120.

When the poppet 124 is open as shown in FIG. 8, a seal is made at point 156 by an O-ring 158 to close off an exhaust passageway 160. Compressed air then enters the chamber 122 which, in turn, enters the drive cylinder 24 to drive the piston 38 downwardly. If the tool 20 is inadvertently disconnected from the compressed air supply while in this position, the compression spring 132 will force the poppet 124 upwardly to close the opening 126 to prevent the tool from operating when it is reconnected to the air supply.

When either the trigger 110 is released or the magazine assembly 28 is returned to its static position, the trigger pin compression spring 142 biases the trigger pin 46 downwardly to reclose the poppet 144. This opens the exhaust passageway 160 to allow the exhaust from the drive cylinder 24 to be vented to atmosphere. The tool 20 is then ready for operation as discussed above.

Obviously, many modifications and variations of the present invention are possible in light of the above teachings. For example, the principles of the invention are equally applicable to a fastener driving tool having a single cycle trigger valve. With such valves, the tool cycles through a drive and a return stroke without releasing the trigger. Thus, it is to be understood that within the scope of the appended claims, the invention may be practiced otherwise than as specifically designated above.

What is claimed and desired to be secured by a Letters Patent is:

1. A fastener driving tool comprising:

a handle portion forming a reservoir for compressed air;

a drive cylinder in flow communication with said reservoir defining a flow communication path therebetween;

a drive piston disposed within said drive cylinder for reciprocal movement;

a driver blade coupled to said drive piston;

a nosepiece assembly coupled to said drive cylinder forming a drive track for said driver blade;

a magazine assembly coupled to said nosepiece assembly carrying a plurality of fasteners pivotally mounted to said tool for allowing a predetermined amount of displacement defining a static position and a drive position including means for advancing said fasteners toward said drive track;

means for controlling the compressed air flow to said drive cylinder including a poppet valve, disposed in said flow communication path;

means for enabling said tool when said magazine assembly is in a drive position and disabling said tool when said magazine assembly is in a static position including means for amplifying the displacement of said magazine assembly; and means for throttling the compressed air flow to said controlling means.

2. A fastener driving tool as recited in claim 1, wherein said amplifying means includes a cam lever pivotally mounted about a pivot point with respect to said magazine assembly and a cam follower.

3. A fastener driving tool as recited in claim 2, wherein said cam follower comprises a fixed pin.

4. A fastener driving tool as recited in claim 2, wherein said cam lever includes a plurality of control surfaces at predetermined radii from said pivot point.

5. A fastener driving tool as recited in claim 4, wherein said control surfaces are formed to provide a linear relationship between the displacement of the magazine assembly and the displacement of said cam lever.

6. A fastener driving tool as recited in claim 4, wherein said control surfaces are formed to provide a non-linear relationship between the displacement of the magazine assembly and the displacement of said cam lever.

7. A fastener driving tool as recited in claim 4, wherein said plurality of control surfaces is two.

8. A fastener driving tool as recited in claim 7, wherein one of said control surfaces is nonlinear.

9. A fastener driving tool as recited in claim 8, wherein the other control surface is a point at a predetermined radius from said pivot point.

10. A fastener driving tool as recited in claim 1, wherein said controlling means includes a poppet valve disposed for reciprocal movement for selectively closing off the compressed air supply to said drive cylinder and a means for biasing said poppet valve.

11. A fastener driving tool as recited in claim 10, wherein said biasing means includes a poppet chamber disposed adjacent said poppet valve.

12. A fastener driving tool as recited in claim 11, wherein said throttling means includes inlet and exhaust ports in flow communication with said poppet chamber.

13. A fastener driving tool as recited in claim 12, wherein said inlet port is formed with a control orifice for throttling said inlet port.

14. A fastener driving tool as recited in claim 12, wherein said exhaust port is formed with a control orifice for throttling said exhaust port.

15. A fastener driving tool as recited in claim 12, wherein said inlet and outlet ports are formed with control orifices for throttling said inlet and exhaust ports.

16. A fastener driving tool comprising:

a handle portion forming a reservoir for compressed air;

a drive cylinder in flow communication with said reservoir;

a drive piston disposed within said drive cylinder for reciprocal movement;

a driver blade coupled to said drive piston;

a nosepiece assembly coupled to said drive cylinder forming a drive track for said driver blade;

a magazine assembly coupled to said nosepiece assembly carrying a plurality of fasteners pivotally mounted to said tool for allowing a predetermined amount of displacement defining a static position and a drive position including means for advancing said fasteners toward said drive track;

means for controlling the compressed air flow to said drive cylinder including a poppet valve disposed to selectively control the flow of compressed air to said drive cylinder and means for enabling said tool when said magazine assembly is in drive position and disabling said tool when said magazine assembly is in a static position including means for amplifying the displacement of said magazine assembly; and means for selectively throttling the differential pressure across said poppet valve.

17. A fastener driving tool as recited in claim 16, wherein said throttling means includes a poppet chamber disposed adjacent said poppet valve defining inlet and exhaust ports.

18. A fastener driving tool as recited in claim 17, further including control orifices for throttling said inlet and exhaust ports.

19. A fastener driving tool comprising:

a handle portion forming a reservoir for compressed air;

a drive cylinder in flow communication with said reservoir;

a drive piston disposed within said drive cylinder for reciprocal movement;

a driver blade coupled to said drive piston;

a nosepiece assembly coupled to said drive cylinder forming a drive track for said driver blade;

a magazine assembly coupled to said nosepiece assembly carrying a plurality of fasteners pivotally mounted to said tool for allowing a predetermined amount of displacement defining a static position and a drive position including means for advancing said fasteners toward said drive track;

means for controlling the compressed air flow to said drive cylinder including a poppet valve disposed to selectively control the flow of compressed air to said drive cylinder and means for enabling said tool when said magazine assembly is in drive position and disabling said tool when said magazine assembly is in a static position including means for amplifying the displacement of said magazine assembly; and means for controlling said poppet valve to cause it to operate with a snap action effect.

20. A fastener driving tool comprising:

a handle portion forming a reservoir for compressed air;

a drive cylinder in flow communication with said reservoir;

a drive piston disposed within said drive cylinder for reciprocal movement;

a driver blade coupled to said drive piston;

a nosepiece assembly coupled to said drive cylinder forming a drive track for said driver blade;

a magazine assembly coupled to said nosepiece assembly carrying a plurality of fasteners pivotally mounted to said tool for allowing a predetermined amount of displacement defining a static position and a drive position including means for advancing said fasteners toward said drive track;

means for controlling the compressed air flow to said drive cylinder including a poppet valve disposed to selectively control the flow of compressed air to said drive cylinder and means for enabling said tool when said magazine assembly is in drive position and disabling said tool when said magazine assembly is in a static position including means for amplifying the displacement of said magazine assembly; and means for controlling the differential pressure across said poppet valve.

21. A fastener driving tool comprising:

a handle portion forming a reservoir for compressed air;

a drive cylinder in flow communication with said air reservoir defining a flow communication path therebetween;

a drive piston disposed within said drive cylinder for reciprocal movement;

a driver blade coupled to said drive piston;

a nosepiece assembly coupled to said drive cylinder forming a drive track for said driver blade;

a magazine assembly coupled to said nosepiece assembly for carrying a plurality of fasteners and advancing said fasteners toward said drive track;

means for controlling the compressed air flow to said drive cylinder including a poppet valve disposed in said flow communication path; and means for throttling the compressed air flow to said controlling means.

22. A fastener driving tool comprising:

a housing;

a drive cylinder disposed within said housing;

a drive piston disposed within said drive cylinder for reciprocal movement;

a driver blade coupled to said drive piston;

a nosepiece assembly coupled to said drive cylinder forming a drive track for said driver blade;

a magazine assembly carrying a plurality of fasteners and coupled to said nosepiece assembly, said magazine assembly being pivotally mounted to said tool for allowing a predetermined amount of displacement between a static position and a drive position spaced from the static position said magazine assembly also including means for advancing said fasteners toward said drive track; and means for amplifying said predetermined displacement of said magazine assembly.

* * * * *